US005116042A

United States Patent [19]

Hamanaka

[11] Patent Number: 5,116,042

[45] Date of Patent: May 26, 1992

[54] DOCUMENT EJECTION APPARATUS WITH REDUCED DOCUMENT EJECTION SPEED

[75] Inventor: Izumi Hamanaka, Hachioji, Japan

[73] Assignee: Konica Corporation, Tokyo, Japan

[21] Appl. No.: 609,919

[22] Filed: Nov. 6, 1990

[30] Foreign Application Priority Data

Nov. 10, 1989 [JP] Japan ..... 1-293266

[51] Int. Cl.[5] ..... B65H 43/00

[52] U.S. Cl. ..... 271/176; 271/182

[58] Field of Search ..... 271/176, 182, 202, 270, 271/273, 314

[56] References Cited

U.S. PATENT DOCUMENTS

| | | | |
|---|---|---|---|
| 4,513,959 | 4/1985 | Kindt | 271/202 X |
| 4,526,361 | 7/1985 | DuBois | 271/270 X |
| 4,569,514 | 2/1986 | Holtje | 271/182 X |
| 4,625,956 | 12/1986 | Marass et al. | 271/176 X |
| 4,693,461 | 9/1987 | Takahashi | 271/176 |
| 4,973,039 | 11/1990 | Jeske et al. | 271/273 X |
| 5,039,083 | 8/1991 | Senn | 271/182 |

FOREIGN PATENT DOCUMENTS

| | | | |
|---|---|---|---|
| 1243966 | 7/1967 | Fed. Rep. of Germany | 271/182 |
| 3938536 | 6/1991 | Fed. Rep. of Germany | 271/182 |
| 2939240 | 5/1981 | Japan | 271/273 |
| 31463 | 2/1985 | Japan | 271/182 |
| 23070 | 1/1986 | Japan | 271/314 |
| 61-178363 | 8/1986 | Japan . | |
| 62-12564 | 1/1987 | Japan . | |
| 27244 | 2/1987 | Japan | 271/182 |
| 46858 | 2/1987 | Japan | 271/270 |
| 62-70159 | 3/1987 | Japan . | |
| 62-111854 | 5/1987 | Japan . | |
| 98540 | 4/1989 | Japan | 271/273 |
| 275364 | 11/1989 | Japan | 271/314 |

*Primary Examiner*—Joseph E. Valenza
*Assistant Examiner*—Boris Milef
*Attorney, Agent, or Firm*—Frishauf, Holtz, Goodman & Woodward

[57] ABSTRACT

A document ejection device for a document conveyor having a document ejecting roller to eject a document sheet from the document conveyor to the outside of the conveyor, and ejecting speed reduction device which reduces the ejecting speed of the document sheet after the document is passed through the ejecting roller. The ejecting speed reduction device has a reduction roller rotating at a circumferential speed lower than the ejecting speed of the document, and a pressing panel or following roller to press the document onto the reduction roller.

8 Claims, 10 Drawing Sheets

DOCUMENT EJECTION APPARATUS WITH REDUCED DOCUMENT EJECTION SPEED

BACKGROUND OF THE INVENTION

The present invention relates to a document ejection apparatus for an automatic document conveyance apparatus, and more particularly to an automatic document conveyance apparatus wherein a document ejection speed is reduced immediately before the completion of document ejection when a document is ejected through an outlet.

In an automatic document conveyance apparatus (hereinafter referred to as ADF) of a copying machine, a document that is set on a document tray is automatically conveyed to a document table and is ejected, after an copying operation made by the copying machine, onto a document ejection tray. The apparatus is suitable for high speed copying for a number of documents in a sheet form. Especially on the recent copying machines, the document conveyance speed in ADF has also been raised (approximately, 1000–1200 mm/sec) under the influence of a copying speed increased for raising copying efficiency. When documents are ejected onto an ejection tray at such a high speed, the documents tend to be ejected irregularly onto the ejection tray, or tend to jump out to the ejection tray, which has been a problem.

For the purpose of solving the problem mentioned above, various suggestions have been made. In Japanese Patent Publication Open to Public Inspection No. 178363/1986 [hereinafter referred to as Japanese Patent O.P.I. Publication] (conventional example 1), for example, there is disclosed a technology comprising a sheet sensor that is provided immediately before a document ejection roller and detects the transit of a document and further comprising a document ejection roller-decelerating means that reduces the speed of revolution of the document ejection roller when the sheet sensor detects the transit of a trailing edge of the document.

In the technology disclosed in Japanese Patent O.P.I. Publication No. 12564/1987 (conventional example 2), on the other hand, there is provided a switching means capable of changing the speed of document ejection either to the first ejecting speed that is the same as a document conveyance speed or to the second ejecting speed that is lower than the first speed by switching the revolution of a document ejection means.

Further, in the technology disclosed in Japanese Patent O.P.I Publication No. 70159/1987 (conventional example 3), the ejection speed is reduced by a brake and a clutch when the trailing edge of a document to be ejected is detected by a sensor.

Furthermore, in the technology disclosed in Japanese Patent O.P.I. Publication No. 111854/1987 (conventional example 4), a document conveyance speed is reduced for a certain period of time after the trailing edge of a document is detected.

Each of aforesaid suggested technologies has its own special features and is effective as measures. However, each of them is not perfect. In Conventional Examples 1 and 4, for example, when a conveyance belt and a document ejection roller are driven by only a single motor, the reduction in speed of the motor is that in speed of the conveyance belt, and it is difficult to convey the next document onto a platen glass while the previous document is ejected, which adversely affects the improvement of productivity of copying. When an additional motor is used, which is different from Conventional Example 1, it is not advantageous in terms of cost. Further, in Conventional Example 2, a gear train for driving is complicated and it requires many gears, resulting in the high cost.

In Conventional Example 3, on the other hand, the combination of a brake and a clutch is complicated and requires many parts, resulting in the high cost and the durability of a clutch which is doubtful.

As stated above, it is necessary to reduce the sheet ejection speed for eliminating that documents are ejected onto an ejection tray irregularly. It has been confirmed experimentally that the linear of a document with which documents are ejected regularly onto an ejection tray that is positioned almost horizontally is 400 mm/sec or less. However, when an automatic document conveyance apparatus is driven totally with the document conveyance speed of 400 mm/sec or less, the ratio of Opm (number of documents to be fed per minute in ADF) to Cpm (number of copies made per minute on a copying machine), namely, the copy productivity (p =Opm/Cpm) is reduced. When Cpm on the copying machine side is made high (e.g. 50–70 copies of A4 size per minute), it is desired to obtain the copying productivity of 100% of such copying rate by achieving a high speed conveyance of documents that is balanced with the copying rate. Further, in order to raise aforesaid linear speed more and yet to achieve the better registration of ejected documents on a sheet ejection tray, the sheet ejection tray has conventionally been inclined and documents to be ejected out of a copying machine have been compelled to climb along the inclined sheet ejection tray to reduce their speed. The total height of an ADF with such a structure tends to be greater, and when the ADF is of a type wherein the ADF swings for opening away from an operator, a part of the ADF may hit the wall behind a copying machine. In order to avoid this, additional space must be provided at the rear side of the copying machine, which results in an increase of floor space for installation.

SUMMARY OF THE INVENTION

An object of the invention is to improve the disadvantageous points mentioned above and to provide a document ejection apparatus for an automatic document conveyance apparatus wherein documents are conveyed at high speed and yet the ejected documents are stacked regularly on a sheet ejection tray.

In an automatic document conveyance apparatus wherein each document is conveyed to the exposure position and then is ejected out of a machine after the completion of each exposure operation, a document ejection apparatus for an automatic document conveyance apparatus of the invention that achieves aforesaid object is characterized in that a ejection speed reduction roller (or belt) whose speed of revolution is lower than that of a document ejection roller and a pressing means capable of pressing on or releasing from the ejecting speed reduction roller are provided downstream the document ejection roller ejecting documents, and both aforesaid ejecting speed reduction roller rotating at a slower speed and the pressing means are kept in contact with pressure after the trailing edge of a document being ejected passes through aforesaid document ejection roller, thus the document is sandwiched therebetween and ejected at a slower speed.

Further, the document ejection apparatus of the invention is characterized in that aforesaid pressing means is a pressure plate capable of being in contact with or being released from the surface of aforesaid ejecting speed reduction roller, or characterized in that aforesaid pressing means is an idle roller capable of being in pressure-contact with, or being released from the circumferential surface of aforesaid ejecting speed reduction roller.

Further, the document ejection apparatus of the invention is characterized in that aforesaid ejecting speed reduction roller is made to be movable and capable of being in pressure-contact with or being released from aforesaid pressure plate.

Or, the invention is characterized in that aforesaid ejecting speed reduction roller is made to be movable and capable of being in pressure-contact with or being released from aforesaid idle roller.

Furthermore, the invention is characterized in that both aforesaid pressing means and ejecting speed reduction roller are made to be movable.

DETAILED DESCRIPTION OF THE INVENTION

Figure 1:
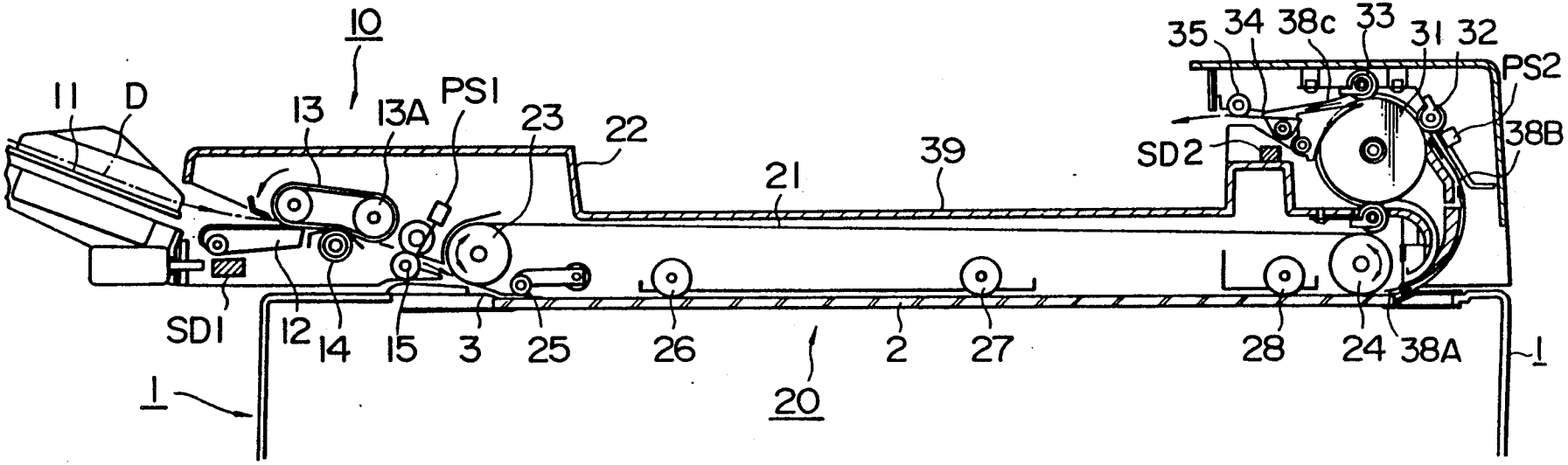
FIG. 1 is a sectional view of an automatic document conveyance apparatus that is an example of the invention.
Figure 2:
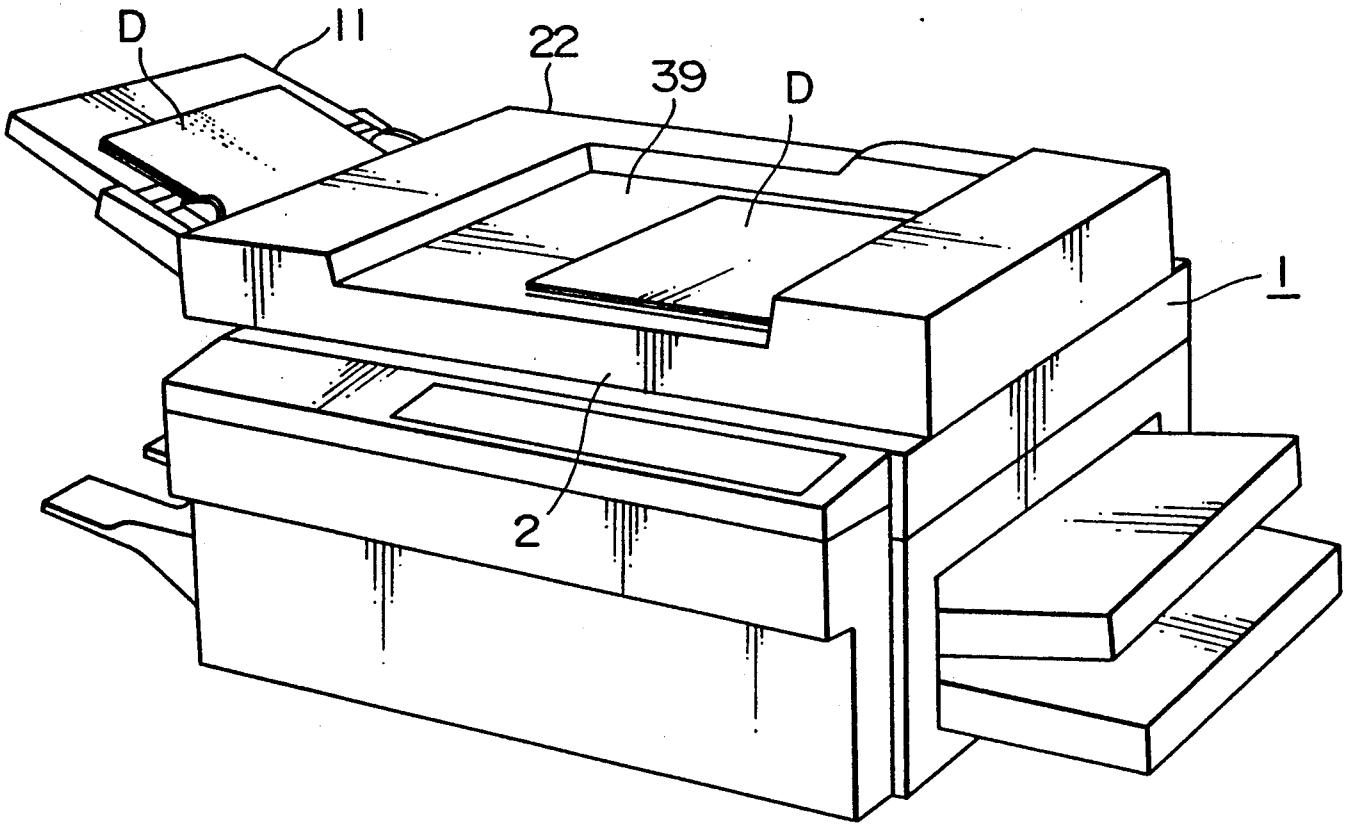
FIG. 2 is a perspective sketch drawing of a copying machine equipped with aforesaid automatic document conveyance apparatus.

FIG. 1 is a sectional view of an automatic document conveyance apparatus that is the first example of the invention and FIG. 2 is a perspective sketch drawing of a copying machine equipped with aforesaid automatic document conveyance apparatus. The automatic document conveyance apparatus (ADF) is provided on the copying stand on copying apparatus main unit 1. The automatic document conveyance apparatus is composed of feeding portion 10, conveyance portion 20 that conveys a document fed by feeding portion 10 to the predetermined position (imagewise exposure scanning position) on platen glass 2 on the document stand and of document ejection portion 30 that ejects the document fed out from aforesaid document conveyance portion after the completion of imagewise exposure onto a sheet ejection tray. On document tray 11 provided protrusively on the side of copying apparatus main unit 1, documents D are set. When a copy button (not shown) is pressed, sheet feeding solenoid SD1 is actuated causing movable guide plate 12 to jump, thus document D is caused to be in pressure-contact with separating belt 13. Then, separating belt 13 is started to run, being driven by motor M, in the arrowed direction by roller 13A connected to driving source, thus only one document D on the top is fed out through the joint operation with stop roller 14. When the leading edge of document D arrives at the outer nip position of sheet feeding roller 15 that rotates in the arrowed direction, aforesaid feeding clutch K is turned off by detected signals from document size detection sensor PSl, thereby transmission of driving force to separating belt 13 is discontinued to cause separating belt 13 to move freely, thus a single preceding document D only is conveyed by feeding roller 15. Document D conveyed by aforesaid feeding roller 15 passes over stopper plate 3 that is for positioning the trailing edge of document D and then arrives at the position of pressure-contact between platen glass 2 provided on the top of copying apparatus main unit 1 and conveyance belt 21 of conveyance portion 20 and then is conveyed by the friction force of conveyance belt 21 that is running further.

Aforesaid conveyance belt 21 is spread between driving roller 23 rotatably supported in a bearing board fixed at both side walls of housing 22 and idle roller 24, and is capable of running, owing to motor M (not shown), either in normal direction or in reverse direction. The bottom surface of running conveyance belt 21 is pressed by pressure rollers 25, 26, 27 and 28 against the surface of platen glass 2. When the trailing edge of document D passes through document size detection sensor PSl and thereby the size of document D is detected automatically, motor M changes its normal rotation to reverse rotation to put back document D that has advanced too far, thus the trailing edge of the document hits stopper plate 3 and stops there. After this, copying operation is made through optical scanning in copying apparatus main unit 1, and after the optical scanning is completed, motor M changes its reverse rotation to normal one, thereby causing conveyance belt 21 to run in the normal direction to convey document D to document ejection portion 30.

Figure 3:
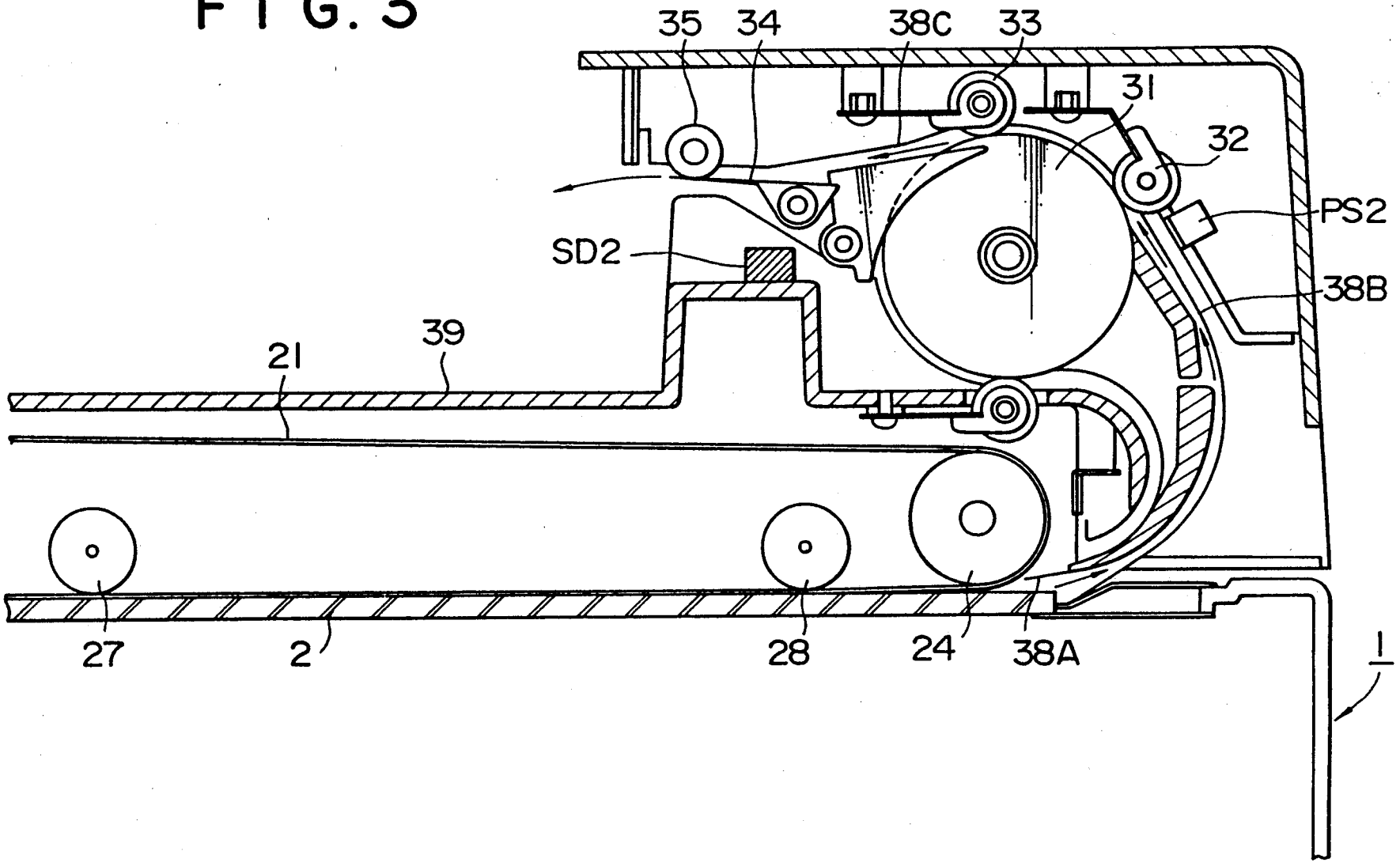
FIG. 3 is a sectional view of a document ejection portion in the first example.

FIG. 3 shows a sectional view of document ejection portion 30 located at the right hand side on the top of copying apparatus main unit 1 in the first example.

Owing to conveyance belt 21, above-mentioned document D forms a conveyance path together with guides 38A, 38B and 38C which guide an arrowed document, document ejection reverse-rotation roller 31 and pinch rollers 32 and 33. Document ejection detection sensor PS2 located in the vicinity of pinch roller 32 detects the trailing edge of conveyed document D, and after a period of time that is needed for holding the trailing edge, document ejection section solenoid SD2 is actuated to cause pressure plate 34 to be moved through attraction, thus the trailing edge and its neighborhood of the document are held between ejecting speed reduction roller 35 rotating at a lower speed and pressure plate 34. In this way, document D which has so far been conveyed at a high speed is suddenly decelerated and ejected onto sheet ejection tray 39, thereby causing a stack of ejected sheets to be well-regulated. Above stated document ejection means, such as document ejection reverse-rotation roller 31, and pinch rollers 32 and 33, can be the one which comprises belts instead of rollers.

Figure 4:
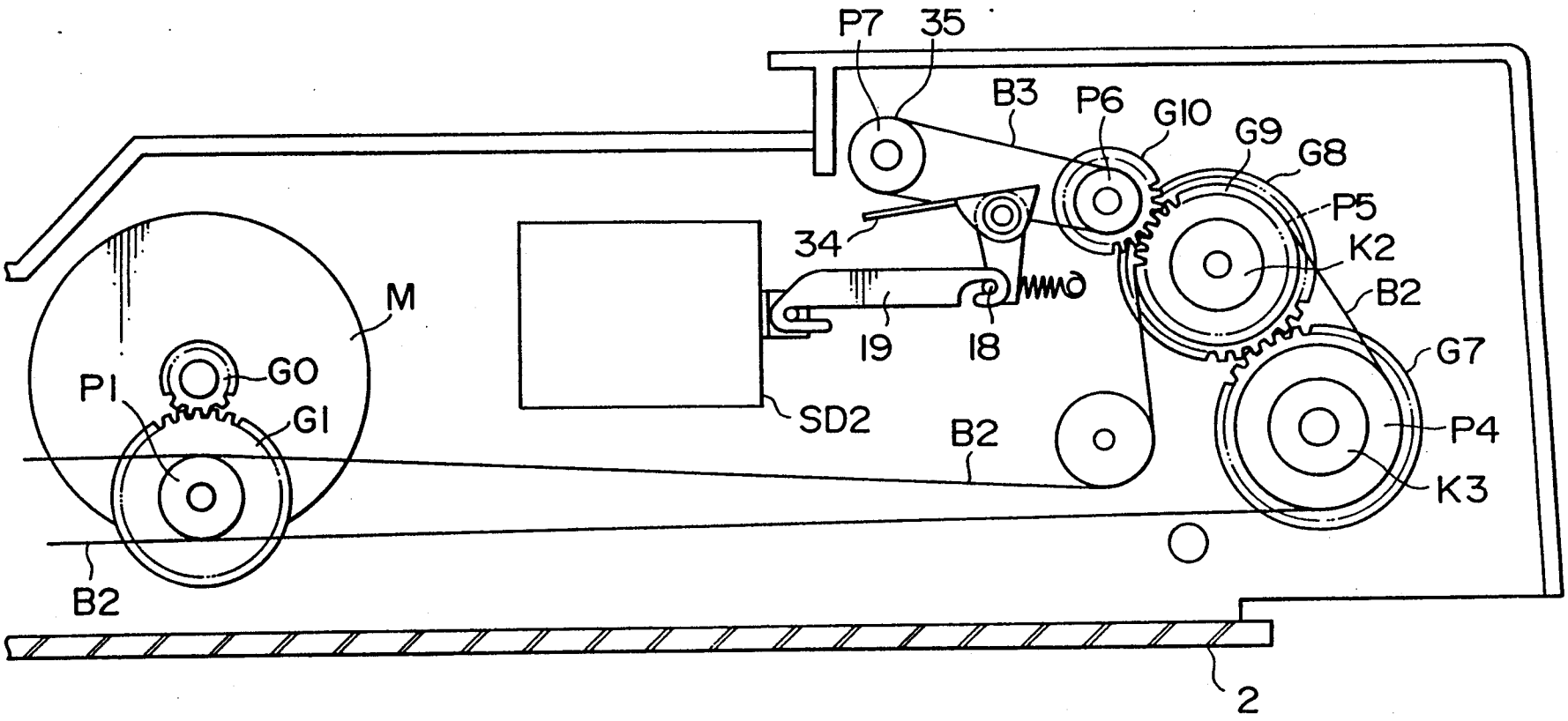
FIG. 4 is a sectional view of a driving unit of a document ejection portion in the first example of the invention.

FIG. 4 is a sectional view showing a driving mechanism of document ejection portion 30 in the first example.

Figure 5:
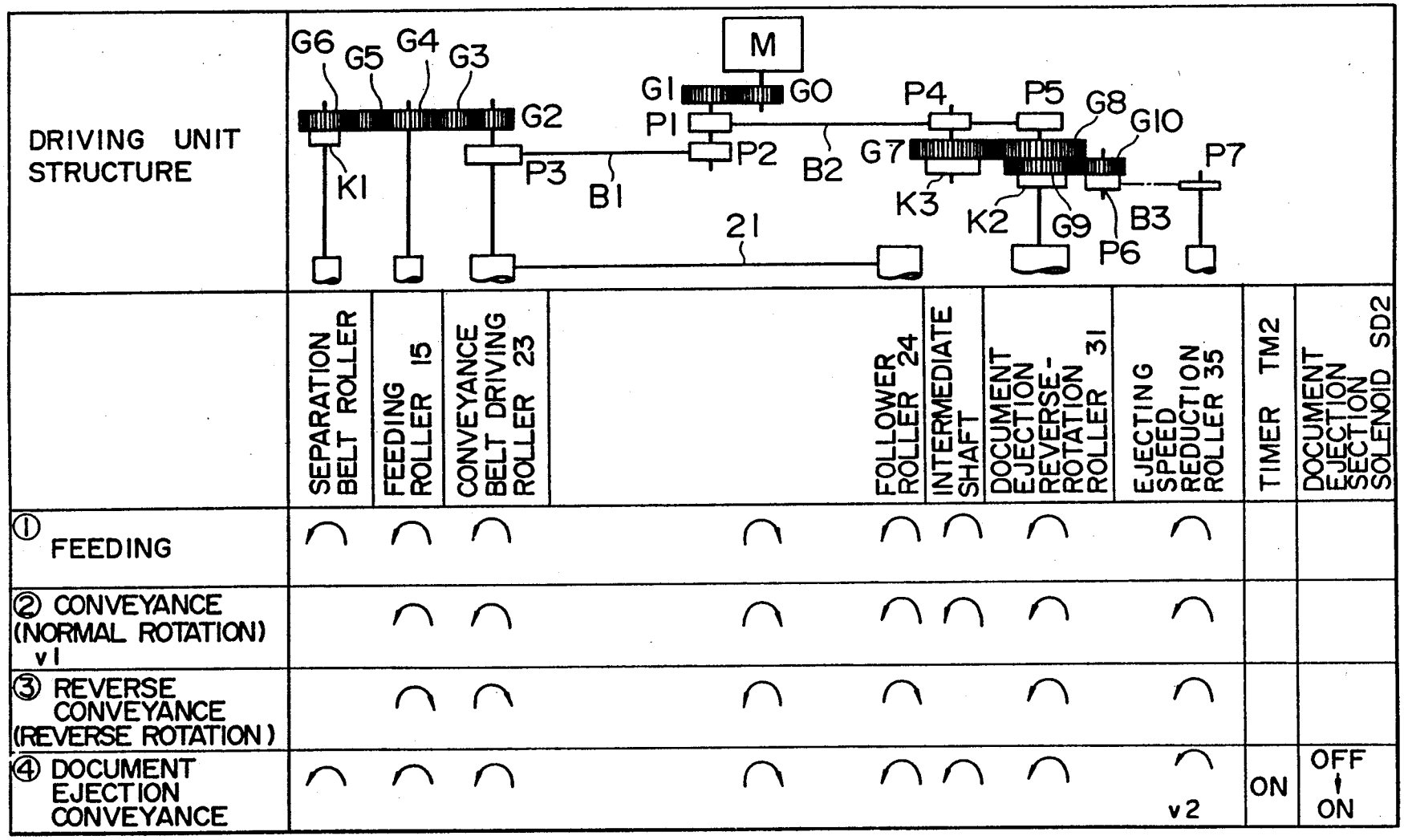
FIG. 5 is a schematic diagram of a total driving unit structure of the first example.

FIG. 5 is a schematic diagram showing a total driving unit of the first example. FIGS. 4 and 5 will be used for the following explanation. A structural diagram of the driving unit structure is shown on the upper portion of FIG. 5. At the center of the diagram, there is shown motor M that is the source for driving, and document feeding portion 10 is shown at the left side of motor M, conveyance portion 20 is shown at the central portion, and a driving mechanism of document ejection portion 30 is shown at the right side of motor M. Through gears G0 and G1, motor M that is the source of driving turns sprocket pulleys P1 and P2 which drive respectively document ejection portion 30 and document feeding portion 10 through timing belts B2 and B1 respectively. Through the gear train composed of G2, G3, G4, G5 and G6, document feeding portion 10 rotates separation belt roller 13A, feeding roller 15 and conveyance belt driving roller 23. Gear G6 located at the tip of roller 13A is equipped with clutch K1 and thereby it is free except for the period of its rotation for sheet feeding. Document ejection reverse-rotation roller 31 is also driven in the same way through gears G0, G1, pulleys P1, P4, P5 and gears G7 and G9, and gear G9 is equipped with one way clutch K2 and gear 7 is equipped with one way clutch K3. In the lower portion of FIG. 5, there are indicated rotation directions (arrow marks) of rollers each for (1) feeding out, (2) conveying (rotation in regular direction), (3) reverse feeding (reverse rotation) and (4) document ejection conveyance.

Figure 6:
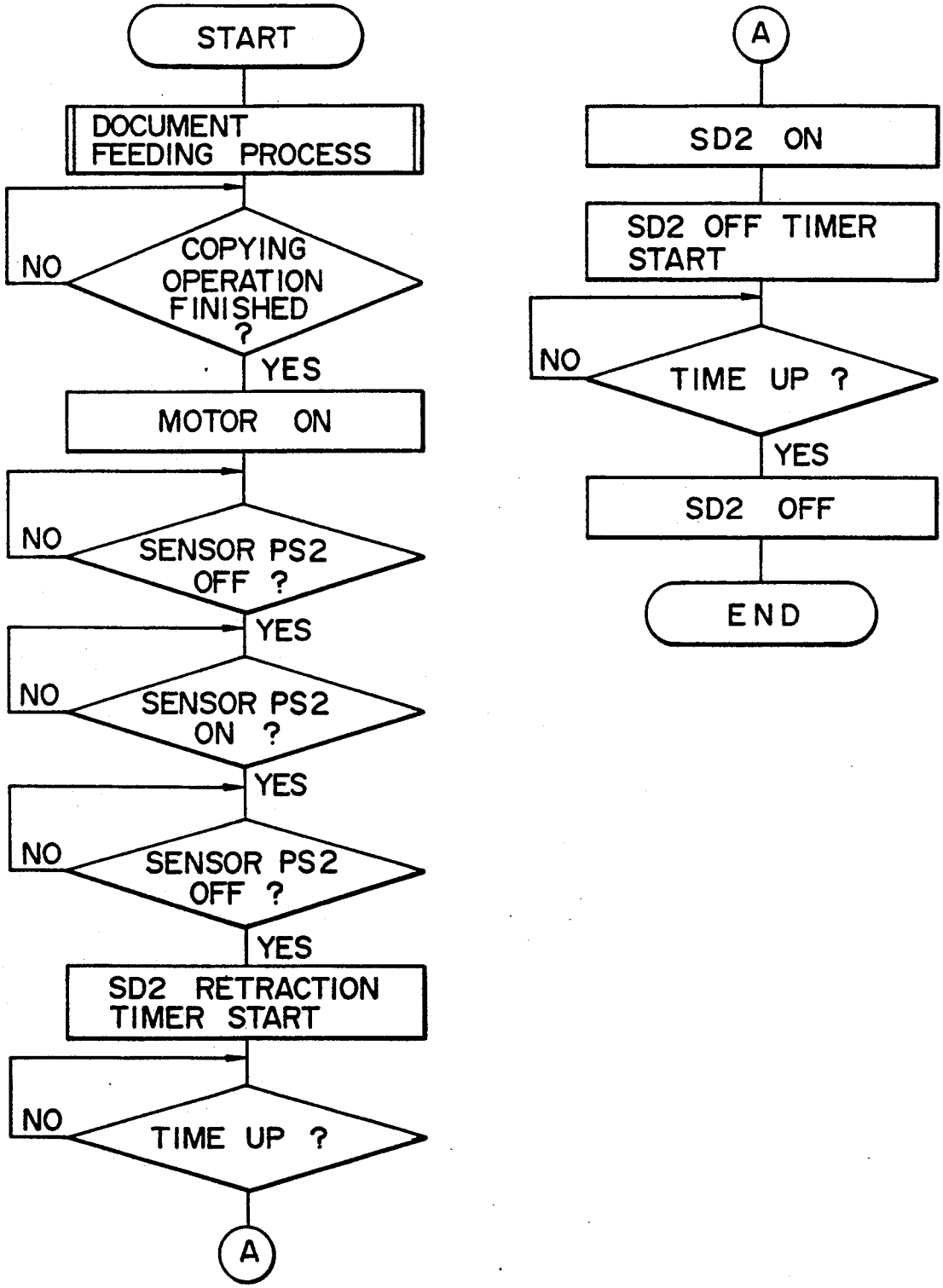
FIG. 6 is a flow chart.
Figure 7:
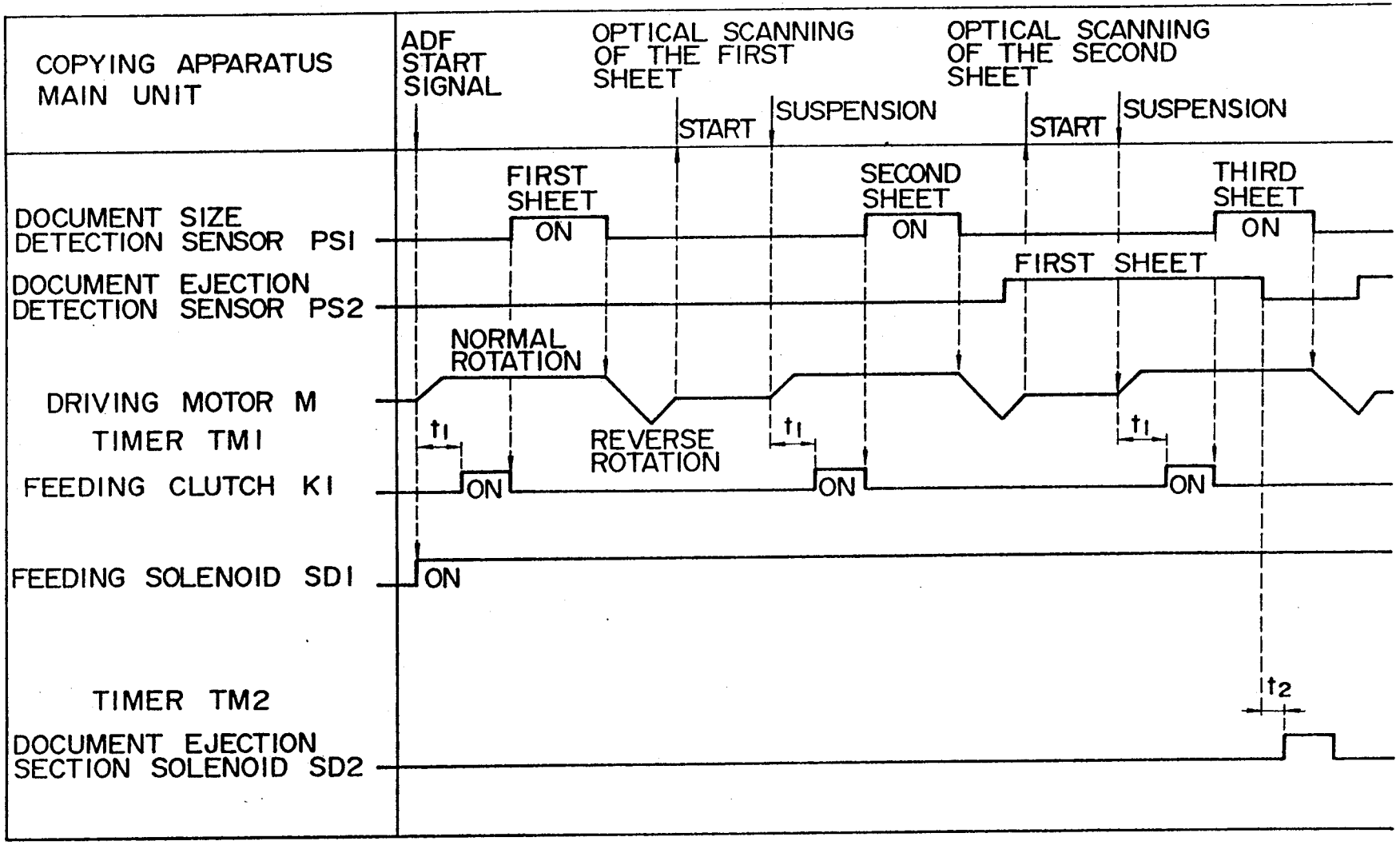
FIG. 7 is a timing chart.

FIG. 6 is a flow chart showing sequence of operations in an automatic document conveyance apparatus of the invention. Detailed explanation of "Sheet feeding process" on the top of the flow chart will be omitted because it is not related to the invention in particular. According to the sequence, motor M is turned on after the completion of copying and thereby document D is conveyed by the rotation of document ejection reverse-rotation roller 31, and then the suction timer starts so that document ejection section solenoid SD2 may cause suction operation when the trailing edge of document D arrives at the point where document ejection detection sensor PS2 is provided, and then document ejection section solenoid SD2 is turned on concurrently with time-up, thus causing ejecting speed reduction roller 35 of a lower speed type to rotate and then document D is held and decelerated to be ejected, and finally document ejection section solenoid SD2 is turned off for restoring to the original position, which is shown in FIG. 6. Next, a timing chart in FIG. 7 will be explained. In the top row, there are indicated timing beginning with ADF start signals (start copying) for documents D beginning from the first document and in the left column, there are indicated timing items such as sensors, driving systems, a clutch and solenoids related to each operation.

Next, the timing chart mentioned above will be explained. With ADF start signals shown on the top of the table, namely when a copy button (not shown) is pressed, driving motor M starts its normal rotation and feeding solenoid SD1 is turned on. Thereby, movable guide plate 12 jumps up, causing document D to be in pressure-contact with separating belt 13. When feeding clutch K1 is turned on after timing t1, separating belt 13 starts rotating and feeding roller 15 conveys the uppermost first sheet among stacked documents D, and the size of the upper most document is detected by document size detection sensor PS1.

When document size detection sensor PS1 finishes detecting the trailing edge of the document and driving motor M for drive rotates reversely and stops so that document D may touch stopper plate 3, an optical scanning, namely an exposure for copying for the first sheet is conducted. The foregoing is conducted in the same timing also for the second sheet among document D. About the time when the size of the second sheet is detected by PS1, the leading edge of the first document D is detected by document ejection detection sensor PS2 which is turned on. In the timing shown in FIG. 7, about the time when the size of the third sheet is detected, document ejection detection sensor PS2 is turned off by the conveyance of the trailing edge of the first sheet of document D and further document ejection section solenoid SD2 is turned on after a period of time allowing ejecting speed reduction roller 35 to pass through the nip point, thus the first sheet is ejected, and after that, documents are ejected in succession in the same manner.

Figure 8:
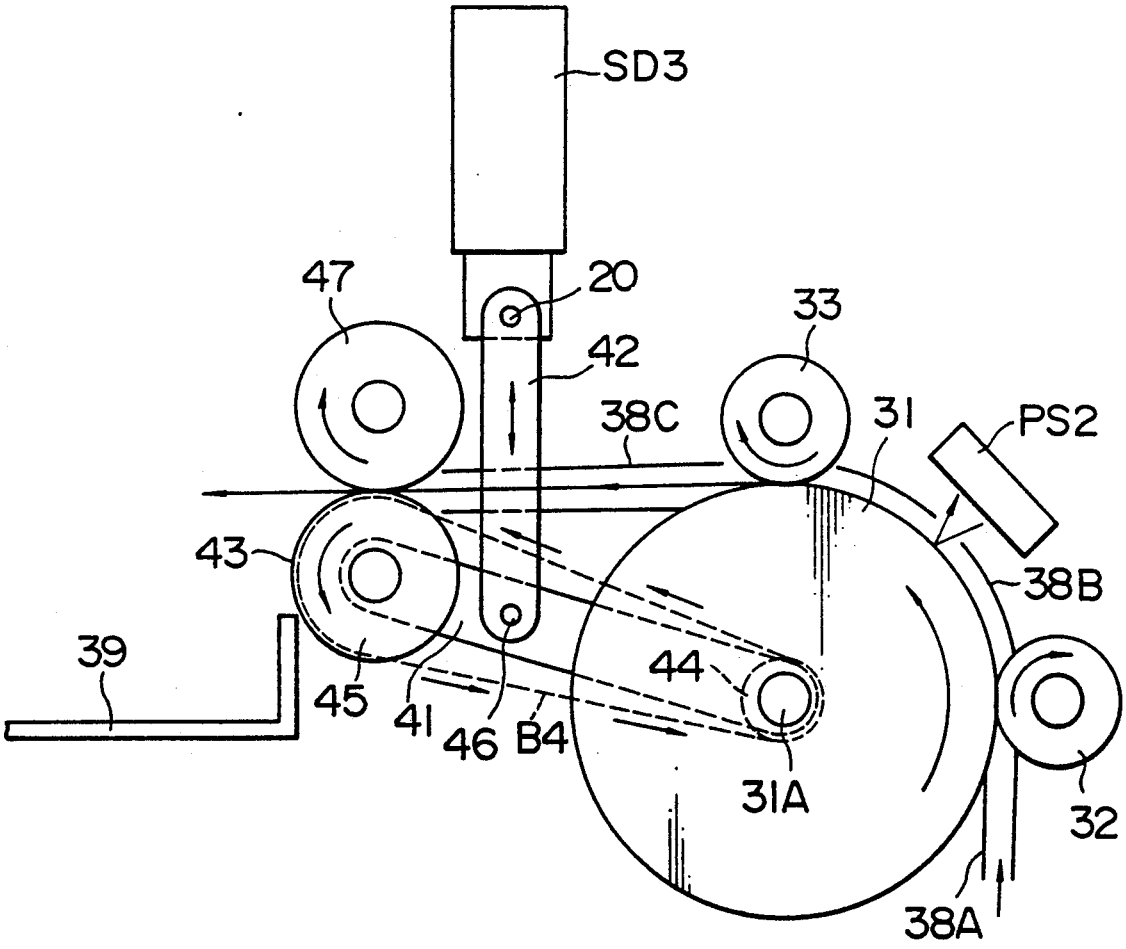
FIG. 8 is a sectional view showing the second example of a sheet ejection portion, FIG. 9 (1) is a schematic diagram of the portion in the vicinity of a ejecting speed reduction roller in the third example, FIG. 9 (2) is a schematic diagram of the fourth example, FIG. 10 (1) is a schematic diagram of the fifth example, FIG. 10 (2) is a schematic diagram of the sixth example, and FIGS. 11 (1), (2) and (3) are schematic diagrams further showing other examples.

FIG. 8 represents the second example of the invention wherein a sectional structural view of document ejection portion 30 in ADF is shown. In order to realize the same function as in the previous example, document ejection portion 30 at the right side on the top of copying apparatus main unit 1 is equipped with document guides 38A, 38B, 38C, document ejection reverse-rotation roller 31 and pinch rollers 32 and 33, and each roller rotates in the arrowed direction and forms the conveyance path. Between pinch rollers 32 and 33, there is provided document ejection detection sensor PS2, and when the trailing edge of document D passes through PS2, the signal therefrom actuates document ejection section solenoid SD3 which thereby attracts, through link 42, arm 41 that is engaged in rotating shaft portion 31A of document ejection reverse-rotation roller 31 and is capable of swinging. Pulley 44 that rotates ejecting speed reduction roller 43 rotatably supported at the tip of arm 41 through belt B4 such as a timing belt or a V-belt is coaxial with rotating shaft portion 31A of document ejection reverse-rotation roller 31 and is capable of transmitting the rotation of document ejection reverse-rotation roller 31 to pulley 45. When the linear speed of document ejection reverse-rotation roller 31 is assumed to be 1200 mm/s, as an example, diameters of pulleys 44 and 45 are determined with the linear speed of 400 mm/s for ejecting speed reduction roller 35 which means the rotation ratio of 3:1.

Owing to the foregoing, when the trailing edge of document D is detected by document ejection detection sensor PS2 and document ejection solenoid SD3 operates for attraction, arm 41 is pulled up through link 42 connected to the arm at shaft 46, and ejecting speed reduction roller 43 fixed coaxially to pulley 45 rotating at low speed touches idle roller 47 whose shaft is stationary in the position above pulley 45 for the transmission of a low speed rotation. Owing to this, document D with a trailing edge detected by aforesaid document ejection detection sensor PS2 properly passes through document conveyance path 38C at necessary timing and further passes through the point where driving roller 43 and idle roller 47 both rotating at low speed to be decelerated suddenly and ejected and stacked on ejection tray 39, resulting in an excellent stack of ejected sheets whose edges are trued up.

Figure 9:
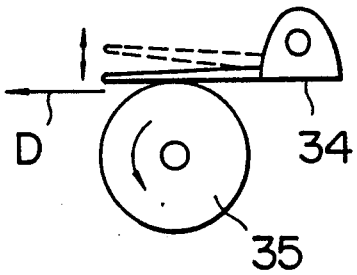
Figure 9:
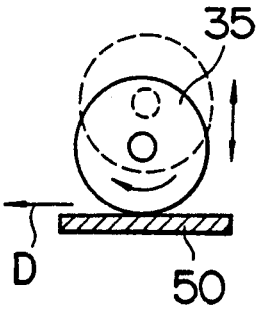

FIG. 9 is a schematic diagram showing third and fourth examples. In the third example in FIG. 9 (1), relation in terms of a position between ejecting speed reduction roller 35 (driving side) and pressure plate 34 is opposite to that in the first example in FIGS. 1, 3 and 4. In the fourth example shown in FIG. 9 (2), on the other hand, there is indicated a variation wherein ejecting speed reduction roller 35 (driving side) is moved vertically against fixed plate 50 so that they may be in pressure-contact for document ejection. It is further possible to employ this method on an upside down basis.

Figure 10:
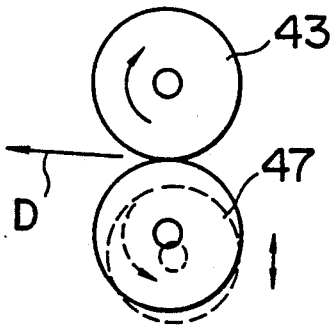
Figure 10:
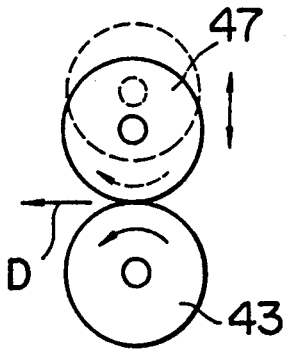

The fifth example shown in FIG. 10 (1) is a variation of the second example in aforesaid FIG. 8 and it shows that lower idle roller 47 moves up and down to be in pressure-contact with driving roller 43 whose shaft is fixed in the position above the lower idle roller for document ejection. The sixth example in FIG. 10 (2) is a variation wherein idle roller 47 is located in the upper part and moved up and down to be in pressure-contact with driving ejecting speed reduction roller 43 whose shaft is fixed below the idle roller for document ejection.

Figure 11:
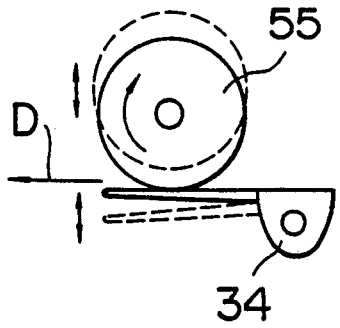
Figure 11:
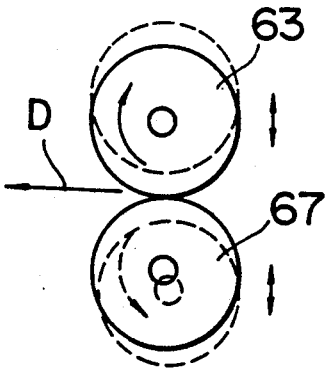
Figure 11:
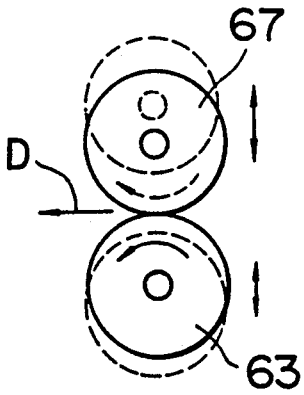

In the seventh example in FIG. 11 (1), an upper roller to be in pressure-contact with aforesaid pressure plate 34 capable of swinging is made to be movable for making contact with or being released from the pressure plate, and ejecting speed reduction roller 55 connected to the driving source is provided. In the eighth example in FIG. 11 (2), both upper ejecting speed reduction roller 63 and lower idle roller 67 are made to be movable up and down for making contact with or being released from each other. In the ninth example in FIG. 11 (3), the example in aforesaid (2) is turned upside down. With regard to the movement of these idle rollers, each of them is released by a cam against the force of a spring when the ejecting speed reduction roller connected to the driving source is moved.

As stated above, the invention includes a method of decelerated document ejection wherein documents are not ejected irregularly even if the conveyance linear speed is raised for the purpose of improvement of copy productivity, and it does not need a sharply inclined sheet ejection tray equipped on a conventional copying machine and thereby needs no upper and left side space, resulting in achievement to provide a compact, light weight and inexpensive apparatus.

What is claimed is:

1. A document ejection apparatus for ejecting a sheet to a tray in a sheet conveyance apparatus, comprising:

a) means for conveying a sheet at a conveying speed;

b) means for reducing the speed of said conveyed sheet and for ejecting said conveyed sheet at a reduced speed to said tray, comprising:

1) means for detecting the passage of said conveyed sheet and for outputting a signal responsive to said detected passage of said conveyed sheet, 2) roller means for rotating at a circumferential speed lower than said conveying speed of said conveying means and disposed between said conveying means and said tray, 3) plate means for pressing said conveyed sheet onto said roller means, said roller means and said plate means being movable relative to each other between a first position at which said plate means is located spaced from said roller means and a second position at which said plate means is in pressure contact with said roller means, said plate means being in said pressure contact with said roller means at a portion of said plate means which is other than a front edge of said plate means, 4) means for moving at least one of said roller means and said plate means from said first position to said second position in response to said signal from said detecting means so as to press said conveyed sheet between said roller means and said plate means to reduce the ejecting speed of said conveyed sheet to a speed lower than said conveying speed, and 5) a timer for delaying said output signal outputted by said detecting means; and wherein said detecting means detects the passage of said conveyed sheet which is being conveyed by said conveying means, and wherein said timer delays said signal outputted by said detecting means so that a trailing edge portion of said conveyed sheet which has passed over said conveying means is pressed between said roller means and said plate means.

2. The apparatus of claim 1, wherein said pressure contacting portion is a middle portion of said plate means.

3. The apparatus of claim 1, wherein said pressure contacting portion is an intermediate portion of said plate means.

4. The apparatus of claim 1, wherein said roller means is fixed and said plate means is movable.

5. The apparatus of claim 1, wherein said roller means is movable and said plate means is fixed.

6. The apparatus of claim 1, wherein both said roller means and said plate means are movable and said moving means moves both said roller means and said plate means.

7. The apparatus of claim 1, further comprising drive means coupled to said roller means to drive said roller means at said lower circumferential speed.

8. The apparatus of claim 1, wherein said plate means comprises a substantially flat plate.

* * * * *